US010199192B2

(12) United States Patent
Beauregard et al.

(10) Patent No.: US 10,199,192 B2
(45) Date of Patent: Feb. 5, 2019

(54) BI-STABLE ELECTRICAL SOLENOID SWITCH

(71) Applicant: LITTELFUSE, INC., Chicago, IL (US)

(72) Inventors: Chad Beauregard, Chicago, IL (US); Justin Kaufman, Chicago, IL (US); Brent Glad, Chicago, IL (US)

(73) Assignee: LITTLEFUSE, INC., Chicago, IL (US)

( * ) Notice: Subject to any disclaimer, the term of this patent is extended or adjusted under 35 U.S.C. 154(b) by 119 days.

(21) Appl. No.: 14/585,339

(22) Filed: Dec. 30, 2014

(65) Prior Publication Data

US 2016/0189900 A1 Jun. 30, 2016

(51) Int. Cl.

| | |
|---|---|
| ***H01H 50/32*** | (2006.01) |
| ***H01H 50/44*** | (2006.01) |
| ***H01H 49/00*** | (2006.01) |
| ***H01F 7/16*** | (2006.01) |
| ***H01H 51/22*** | (2006.01) |

(52) U.S. Cl.

CPC ..... *H01H 50/32* (2013.01); *H01F 7/1615* (2013.01); *H01H 49/00* (2013.01); *H01H 50/443* (2013.01); *H01H 51/2209* (2013.01); *H01H 51/2263* (2013.01)

(58) Field of Classification Search

CPC ..... H01F 7/122; H01F 7/1615; H01F 7/1646; H01H 2051/2218; H01H 51/2209; Y10T 29/49075

USPC ..... 335/170, 171, 177, 179, 233, 234

See application file for complete search history.

(56) References Cited

U.S. PATENT DOCUMENTS

| | | | | |
|---|---|---|---|---|
| 2,919,324 A | | 12/1959 | Schuessler | |
| 4,644,311 A | * | 2/1987 | Guery | H01H 51/2209 335/230 |
| 5,272,458 A | * | 12/1993 | Hoffman | H01H 51/2209 335/179 |
| 5,883,557 A | * | 3/1999 | Pawlak | H01H 51/2209 335/177 |

(Continued)

FOREIGN PATENT DOCUMENTS

| | | |
|---|---|---|
| EP | 2141723 A2 | 1/2010 |
| FR | 2875637 A1 | 3/2006 |

(Continued)

OTHER PUBLICATIONS

European Search Report dated Jun. 9, 2016 in corresponding EP Application No. 15194682.9.

*Primary Examiner* — Bernard Rojas

(57) ABSTRACT

An improved bi-stable electrical solenoid switch comprising a solenoid being wound with coil windings. The solenoid having a central aperture defined therein, and the coil windings, which when engaged by a power source, generates a magnetic field. A magnetic coupling member mounted on the solenoid. A plunger partially disposed in the central aperture for movement into and out of the central aperture. A conductive plate coupled to the plunger and provided with contacts on each end of the conductive plate. The conductive plate configured to electrically engage and disengage the solenoid upon respective application of power to the solenoid. The magnetic coupling member configured to reduce the force needed by the solenoid to remain in an open position when selectively energized for moving and retaining the conductive plate of the plunger against the solenoid for allowing wide operating voltage and reduced operating power.

17 Claims, 7 Drawing Sheets

(56) References Cited

U.S. PATENT DOCUMENTS

| | | | | |
|---|---|---|---|---|
| 7,233,220 | B2 * | 6/2007 | Batteux | H01H 1/54 335/179 |
| 8,274,348 | B2 * | 9/2012 | Kolb | H01F 7/1615 335/229 |
| 2008/0122562 | A1 | 5/2008 | Bush | |
| 2011/0080240 | A1 * | 4/2011 | Patino | H01H 51/2209 335/229 |

FOREIGN PATENT DOCUMENTS

| | | | |
|---|---|---|---|
| GB | 2099223 | A | 12/1982 |
| WO | 2014023326 | A1 | 2/2014 |

* cited by examiner

300

OPEN/UNPOWERED POSITION

300

CLOSED/POWERED POSITION

300

OPEN/UNPOWERED POSITION

300

CLOSED/POWERED POSITION

BI-STABLE ELECTRICAL SOLENOID SWITCH

FIELD OF THE DISCLOSURE

The disclosure relates generally to the field of circuit protection devices and more particularly to a bi-stable solenoid switch with a wide operating voltage.

BACKGROUND OF THE DISCLOSURE

An electrical relay is a device that enables a connection to be made between two electrodes in order to transmit a current. A relay typically comprises a coil and a magnetic switch. When current flows through the coil, a magnetic field is created proportional to the current flow. At a predetermined point, the magnetic field is sufficiently strong to pull the switch's movable contact from its rest, or de-energized position, to its actuated, or energized position pressed against the switch's stationary contact. When the electrical power applied to the coil drops, the strength of the magnetic field drops, releasing the movable contact and allowing it to return to its original de-energized position. As the contacts of a relay are opened or closed, there is an electrical discharge called arcing, which may cause heating and burning of the contacts and typically results in degradation and eventual destruction of the contacts over time.

A solenoid is a specific type of high-current electromagnetic relay. Solenoid operated switches are widely used to supply power to a load device in response to a relatively low level control current supplied to the solenoid. Solenoids may be used in a variety of applications. For example, solenoids may be used in electric starters for ease and convenience of starting various vehicles, including conventional automobiles, trucks, lawn tractors, larger lawn mowers, and the like.

A normally open relay is a switch that keeps its contacts closed while being supplied with the electric power and that opens its contacts when the power supply is cut off. Currently, normally open relays have limited operating voltage ranges. For example, normally open relays are limited to operate in either 12 or 24 volt ranges. Yet relays that operate over a wide range of voltages are bi-stable. The bi-stable relay is used for high-current ranges, but negatively result in a high temperature rise. Thus, a need exists for an improved bi-stable electrical solenoid switch having a constant current source capable of operating in a constant current mode allowing for a wide operating voltage range and a lower operating power. It is with respect to these and other considerations that the present improvements have been needed.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Various embodiments are generally directed to a bi-stable solenoid electrical switch having a solenoid bobbin forming a solenoid by being wound with coil windings. The solenoid bobbin having a central aperture defined therein, and the coil windings, which when engaged by a power source, generate a magnetic field. A magnetic coupling member mounted on the solenoid surrounding at least a portion of the central aperture. A plunger at least partially disposed in the central aperture for rotation and axial reciprocation between at least two positions into and out of the central aperture relative to the solenoid and the magnetic coupling member. A conductive plate coupled to the plunger and provided with contacts on each end of the conductive plate. The conductive plate configured to electrically engage and disengage the solenoid upon respective application of power to the solenoid. The magnetic field latching and unlatching the plunger between the at least two positions. The magnetic coupling member configured to reduce the force needed by the magnetic field for allowing the solenoid to remain in an open position when selectively energized for operating in a constant current mode for allowing a wide operating voltage and reduced operating power. The magnetic coupling member retaining the plunger in one of the at least two positions. Other embodiments of the bi-stable solenoid electrical switch are described and claimed herein.

Various embodiments are generally directed to bi-stable electrical solenoid switch comprising a solenoid being wound with coil windings. The solenoid having a central aperture defined therein, and the coil windings, which when engaged by a power source, generate a magnetic field. A magnetic coupling member mounted on the solenoid. A plunger partially disposed in the central aperture for movement into and out of the central aperture. A conductive plate coupled to the plunger and provided with contacts on each end of the conductive plate. The conductive plate configured to electrically engage and disengage the solenoid upon respective application of power to the solenoid. The magnetic coupling member configured to reduce the force needed by the solenoid to remain in an open position when selectively energized for moving and retaining the conductive plate of the plunger against the solenoid for allowing wide operating voltage and reduced operating power.

Various embodiments are generally directed to method for forming a solenoid electrical switch in accordance with the present disclosure may include the steps of providing a solenoid being wound with coil windings, the solenoid having a central aperture defined therein, and the coil windings, which when engaged by a power source, generate a magnetic field, providing a magnetic coupling member mounted on the solenoid, providing a plunger at least partially disposed in the central aperture for movement into and out of the central aperture, providing a conductive plate coupled to the plunger and provided with contacts on each end of the conductive plate, the conductive plate configured to electrically engage and disengage the solenoid upon respective application of power to the solenoid. The magnetic coupling member configured to reduce the force needed by the solenoid to remain in an open position when selectively energized for moving and retaining the conductive plate of the plunger against the solenoid for allowing wide operating voltage and reduced operating power.

BRIEF DESCRIPTION OF THE DRAWINGS

By way of example, specific embodiments of the disclosed device will now be described, with reference to the accompanying drawings, in which.

DETAILED DESCRIPTION

Figure 1A:
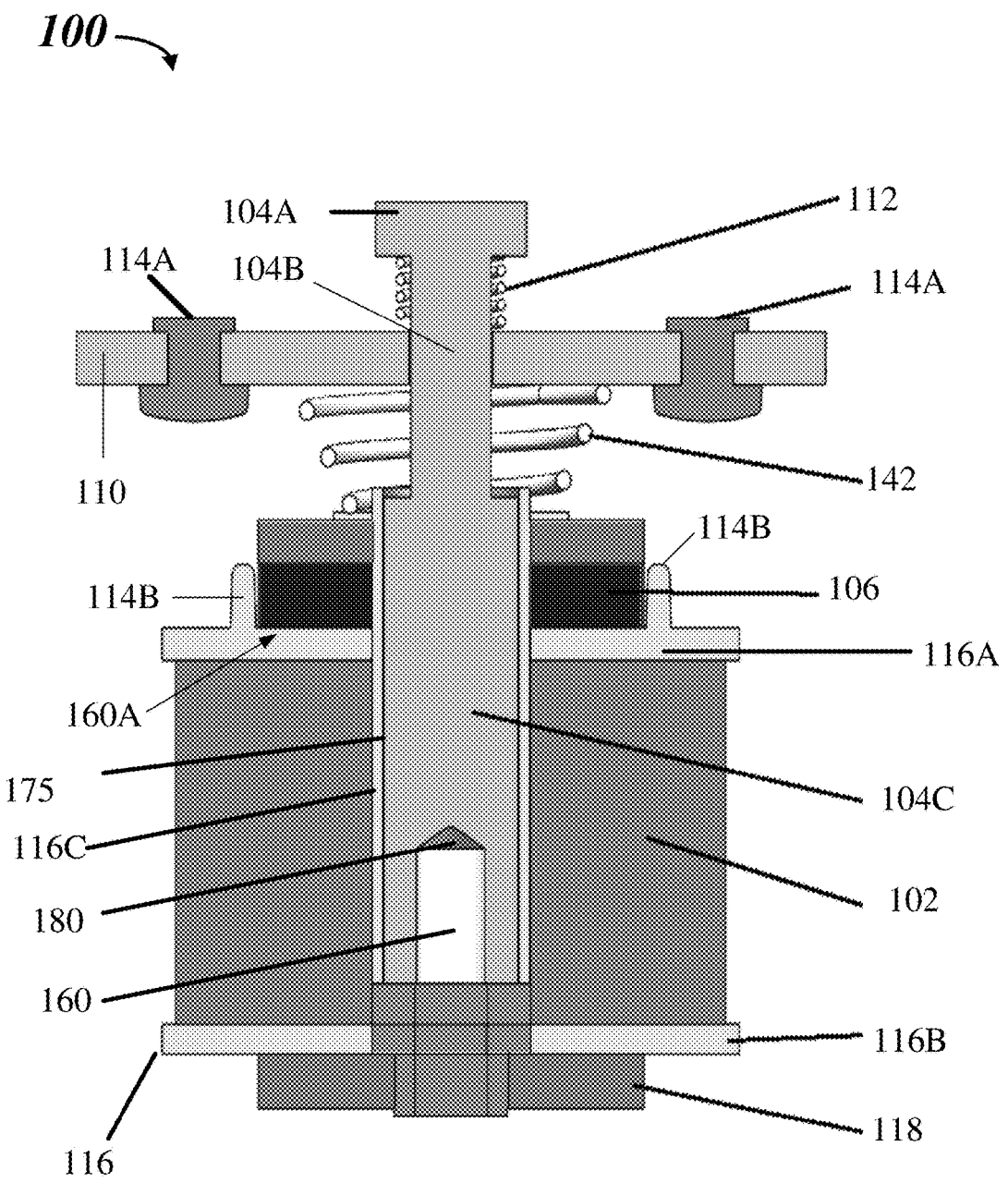
FIG. 1A illustrates a perspective cross-sectional view of an exemplary electrical solenoid switch in accordance with the present disclosure.

The present disclosure will now be described more fully hereinafter with reference to the accompanying drawings, in which preferred embodiments of the present disclosure are shown. The present disclosure may be embodied in many different forms and should not be construed as limited to the embodiments set forth herein. Rather, these embodiments are provided so that this disclosure will be thorough and complete, and will fully convey the scope of the present disclosure to those skilled in the art. In the drawings, like numbers refer to like elements throughout.

Figure 1B:
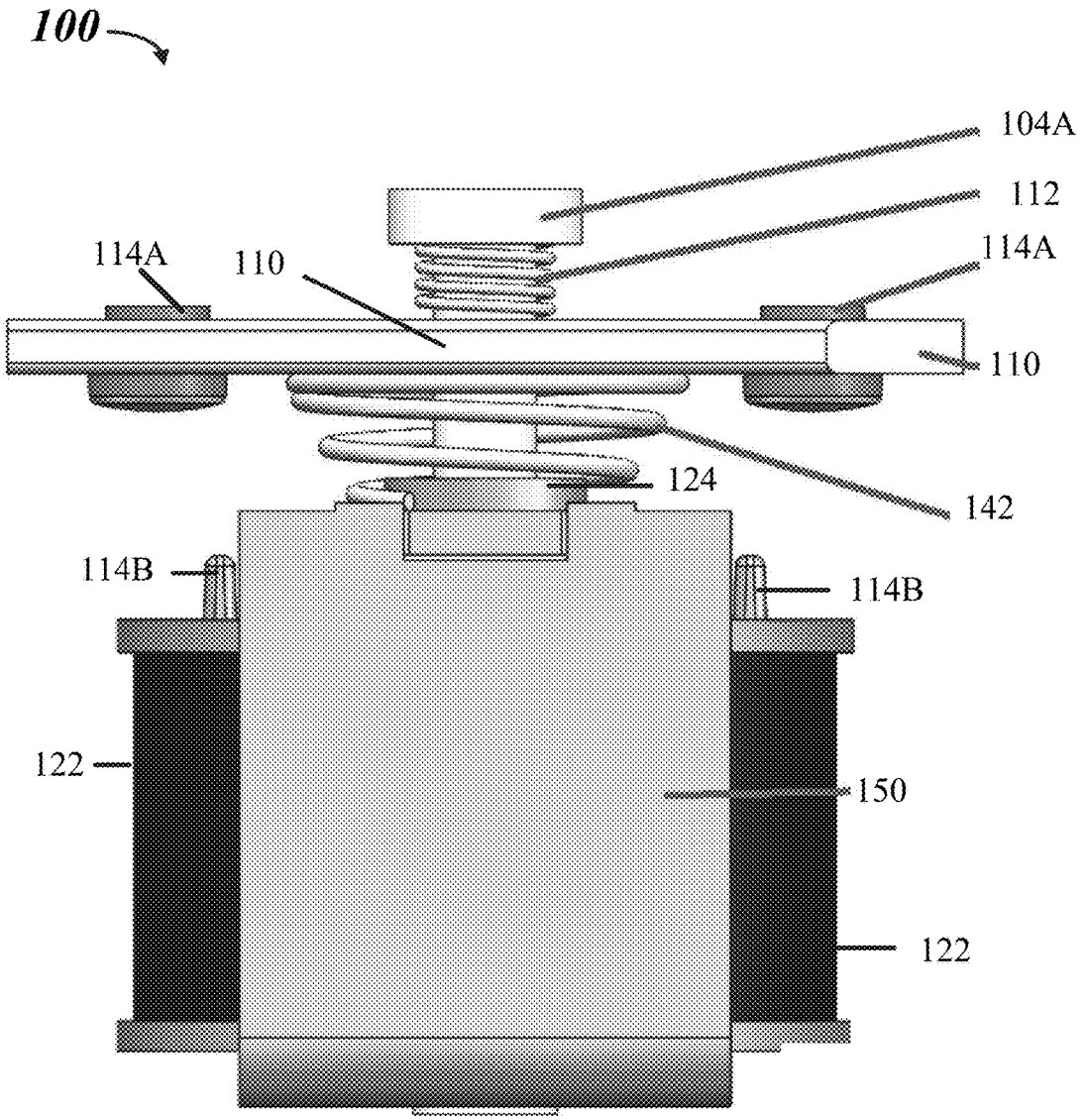
FIG. 1B illustrates a perspective view of an exemplary electrical solenoid switch in accordance with the present disclosure.

FIG. 1A illustrates a perspective cross-sectional view of an exemplary electrical solenoid switch 100 in accordance with the present disclosure and FIG. 1B illustrates a perspective view of the exemplary electrical solenoid switch 100. The electrical solenoid switch 100, such as, for example, a bi-stable electrical solenoid switch, includes a solenoid bobbin 116 (e.g., a solenoid bobbin housing). The solenoid bobbin 116 is formed within a solenoid body 150 with coil windings 102 wound around the solenoid bobbin 116. The solenoid bobbin 116 has a body or connection piece 116C with includes a top section 116A (e.g., a first end) connected to a bottom section 116B (e.g., a second end) via the connection piece 116C. A solenoid shroud 122 surrounds and protects the coil windings 102. The solenoid shroud 122 is more clearly depicted in FIG. 1B. The connection piece 116C may be defined in one of multiple geometric configurations. For example, the connection piece 116C may be a circular pipe shaped having a predetermined thickness and predetermined diameter. The solenoid body 150, or more specifically the solenoid bobbin 116, includes a central aperture 175 defined therein, and the coil windings 102, which when engaged by a power source, generate a magnetic field. More specifically, the central aperture 175 may be formed within the connection piece 116C, such as within the connection piece 116C. The solenoid body 150 also includes a solenoid frame 118 disposed beneath the solenoid bobbin 116 for additional support and protection of the solenoid body 150. The solenoid body 150 may include an iron core 160 positioned inside the central aperture 175. A compression spring 180 may be disposed on the iron core 160 for creating a buffer and shock absorber between the plunger 104 and the iron core 160. The compression spring 180 may also be composed of a conductive material.

In one embodiment, the top section 116A of the solenoid bobbin 116 includes electric contact 114B, which may be one or more vertically extending electrical contacts, spaced a distance away from one another to define a trench 160A. The trench extending from the at least two vertically extending electric contacts 114B and the connection piece 116C 116B. In one embodiment, the electric contacts 114B are silver alloy contacts. A magnetic coupling member 106, such as a magnet, may be mounted on the solenoid body 150 and extends horizontally and/or vertically within the defined trench 160A and proximate to the electric contacts 114B. The magnetic coupling member 106 may surround at least a portion of the central aperture 175 and the connection piece 116C, 116B.

A plunger 104 is at least partially disposed in the central aperture 175 for rotation and axial reciprocation between at least two positions into and out of the central aperture 175 relative to the solenoid body 150 and the magnetic coupling member 106. The plunger 104 collectively illustrated in FIG. 1A showing a top portion 104A of the plunger 104, a middle portion 104B, and a bottom portion 104C of the plunger 104. The bottom portion 104C is at least partially disposed in the central aperture 175 and the middle portion 104B is coupled to a conductive plate 110 (e.g., an input conductive plate), such as a movable bus bar. The plunger 104 is magnetically attracted towards the magnetic coupling member 106.

The conductive plate 110 is coupled to the plunger 104 and provided with one or more electric contacts 114A on each end of the conductive plate 110. In one embodiment, the electric contacts 114A (e.g., electrical contacts) are silver alloy contacts. The conductive plate 110 may be configured to electrically engage and disengage the solenoid body 150 upon respective application of power to the solenoid body 150. In one embodiment, the electrical contacts 114B are configured for electrically engaging and disengaging the electric contacts 114A for opening (powered off) and closing (powered on) the electrical solenoid switch 100.

The magnetic field latches and unlatches the plunger 104 between the at least two positions, such as an open position (powered off) and a closed position (powered on) of the electrical solenoid switch 100. The magnetic coupling member 106 is configured to reduce the force necessary by the magnetic field for allowing the solenoid body 150 to remain in an open position when selectively energized for operating in a constant current mode for allowing a wide operating voltage and reduced operating power. The magnetic coupling member 106 retains the plunger 104 in one of the at least two positions. The constant current mode allows for a multi-stage peak-an-hold current. The wide operating voltage is within a range of 5 to 32 volts.

The conductive plate 110, coil windings 102, the electric contacts 114A and 114B, and the plunger 104 may be formed of any suitable, electrically conductive material, such as copper or tin, and may be formed as a wire, a ribbon, a metal link, a spiral wound wire, a film, an electrically conductive core deposited on a substrate, or any other suitable structure or configuration for providing a circuit interrupt. The conductive materials may be decided based on fusing characteristic and durability. In one embodiment, the plunger is a steel material and may include stainless steel caps covering the electric contacts 114A and the electric contacts 114B and/or may be positioned on each end of the conductive plate 110. The electric contacts 114A and the electric contacts 114B may also be stainless steel.

As depicted more clearly in FIG. 1B, the electric contacts 114B (e.g., solenoid conductive contacts) electrically engage electric contacts 114A (e.g., conductive plate contacts) when power to the electrical solenoid switch 100 is provided and the conductive plate 110 moves as a result of the magnetic field generated in the coil windings 102 and the magnetic coupling member 106.

The exemplary electrical solenoid switch 100 also includes the first spring 142, such as a return spring, disposed between the magnetic coupling member 106 and the conductive plate 110. A retaining device 124, such as a washer riveted onto the solenoid, or more specifically, is disposed between the magnetic coupling member 106 and the first spring 142. The first spring 142 creates a hammer effect to break the contacts between the electric contacts 114A and electric contacts 114B when power to the electrical solenoid switch 100 is removed. The first spring 142 may be configured to overcome the force of the magnetic coupling member 106 necessary to retain the conductive plate 110, which is energized, in the engaged position with solenoid body 150 so that the electrical solenoid switch 100 may be in the open position. The first spring 142 displaces the plunger 104 back to an alternative one of the at least two positions when the power source is disengaged from the solenoid body 150. By displacing the plunger 104 back to an alternative one of the at least two positions, the first spring 142 overcomes the force of the magnetic coupling member 106 and the conductive plate 110 disengages the solenoid body 150.

The exemplary electrical solenoid switch 100 also includes a second spring 112, such as an over travel spring, disposed between the conductive plate 110 and the top portion 104A of the plunger 104. The second spring 112 prevents the conductive plate 110 from traveling a distance that causes the conductive plate 110 to hit or make contact with the top portion 104A of the plunger 104. In one embodiment, the first spring 142, together with the second spring 112, assist in securing the conductive plate 110 (e.g., a contact plate) to the plunger 104 in a fixed and/or adjustable position. For example, the first spring 142, together with the second spring 112, are positioned such that the force of the first spring 142 pushing up from beneath the contact plate and the force of the second spring 112 pushing down from above the conductive plate 110 are such so as to assist the conductive plate 110 from bending or moving so as to remain parallel to the magnetic coupling member 106.

Figure 2:
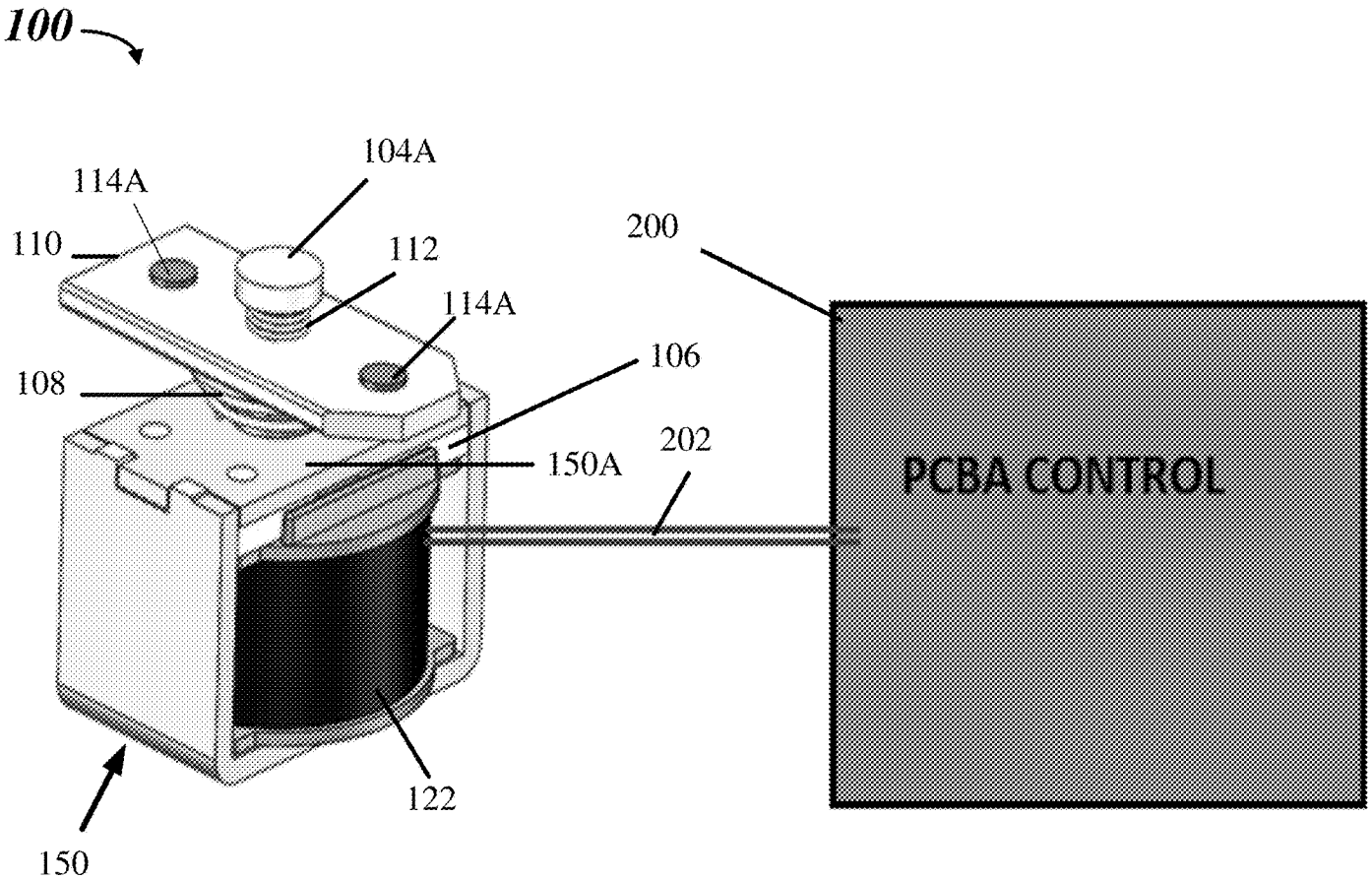
FIG. 2 illustrates a perspective view of the exemplary electrical solenoid switch in FIG. 1 connected to a circuit in accordance with the present disclosure.

FIG. 2 illustrates a perspective view of the exemplary electrical solenoid switch 100 in FIG. 1 connected to a circuit in accordance with the present disclosure. A controller 200, such as printed circuit board assembly (PCBA) controller, is configured to receive the electrical solenoid switch 100 to provide electrical connection between the electrical solenoid switch 100, a power source, and other circuitry. An electrical connection 202 is provided for providing power to the electrical solenoid switch 100. More specifically, the coil windings 102 are connected to the controller 200.

A pair of electrical contacts, such as, for example the electric contacts 114A and 114B, is immovably mounted on each end of the conductive plate 110. When selectively energized, the electric contacts 114A mutually touch the solenoid conductive contacts, such as the electric contacts 114B, in a first position (closed). When selectively de-energized by loss of power, the electric contacts 114A and the electric contacts 114B are mutually separated in a second position (open), with the magnetic coupling member 106 being a means for keeping the contacts in the first and in the second position. Thus, the magnetic coupling member 106 assist the plunger 104 to reduce the force necessary by the coil windings 102 to hold the electrical solenoid switch 100 open and operate the coil windings in a constant current mode to allow multi-stage peak-and-hold current that allows wide operating voltage and lower operating power.

For example, the behavior of the electrical solenoid switch 100 may be explained as follows. As the electromagnetic coil windings 102 are connected to the controller 200, the plunger 104, which has been held in an uppermost position (a first position) by the actions of the first spring 142, which may be a coiled spring, will be forced to move downwardly within the central aperture 175, while compressing the first spring 142 against the spring force of this the first spring 142. The downward movement is a result of a magnetic force generated within the coil windings 102, which have been energized from a constant current mode operation. Because the plunger 104 is magnetically attracted to the magnetic coupling member 106, the magnetic coupling member 106 reduces the overall amount of the magnetic force necessary for creating the downward movement of the plunger 104 and retaining the plunger 104 in this closed position. In the closed position, the electric contacts 114A mutually touch the solenoid conductive contacts, such as the electric contacts 114B, in the first position, such as a closed or "powered on" position.

Then, as the supply of the constant current to the coil windings 102 are suspended, the plunger 104 will be forced to return to its initial position (a first position) by the restoring forces of the first spring 142 applied to the plunger 104 while simultaneously overcoming the magnetic attraction of the plunger 104 to the magnetic coupling member 106. The electric contacts 114A disengaged from the solenoid conductive contacts, such as the electric contacts 114B, in the second position, such as an open or "powered off" position when the plunger 104 is forced to return to its initial position (a first position) by the restoring forces of the first spring 142 applied to the plunger 104.

Figure 3A:
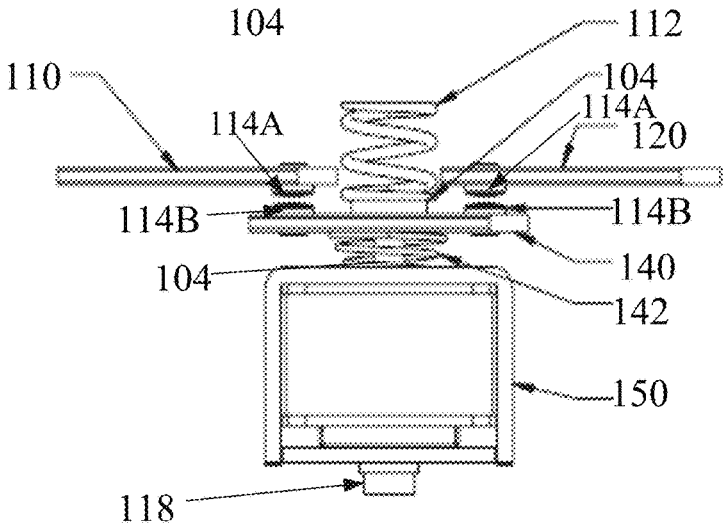
FIG. 3A illustrates a perspective view of an exemplary electrical solenoid switch in an open/unpowered position in accordance with the present disclosure.
Figure 3B:
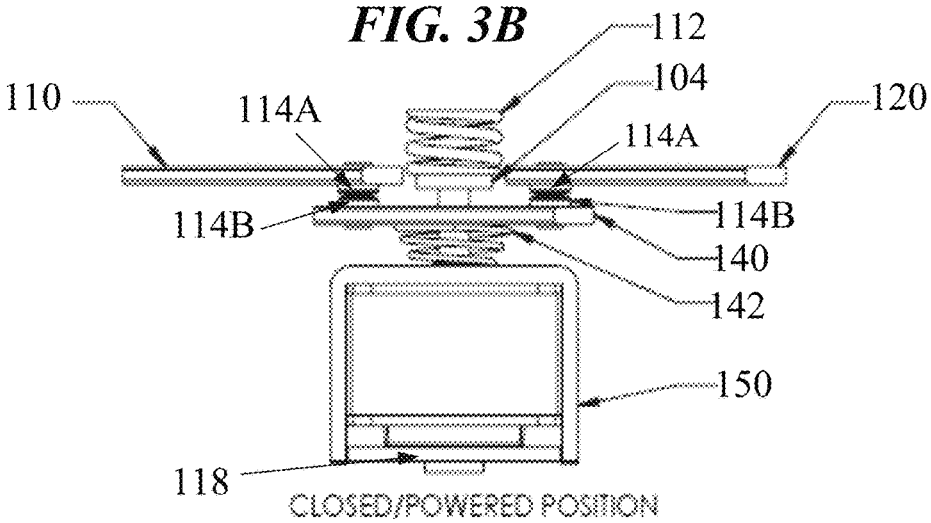
FIG. 3B illustrates a perspective view of an exemplary electrical solenoid switch in a closed/powered position in accordance with the present disclosure.
Figure 3C:
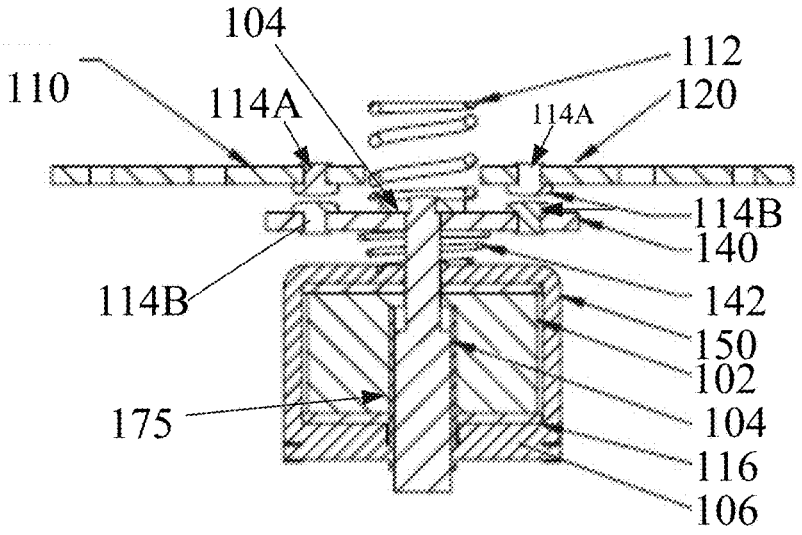
FIG. 3C illustrates a perspective cross-sectional view of an exemplary electrical solenoid switch in an open/unpowered position in accordance with the present disclosure.
Figure 3D:
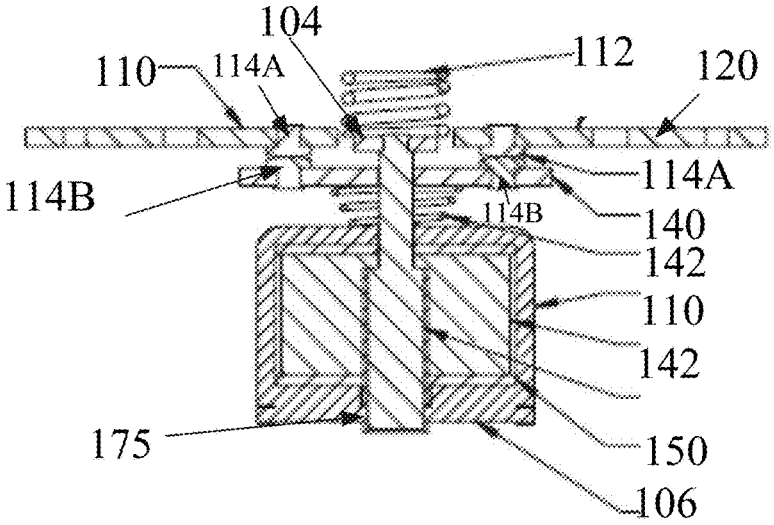
FIG. 3D illustrates a perspective cross-sectional view of an exemplary electrical solenoid switch in a closed/powered position in accordance with the present disclosure.

FIG. 3A illustrates a perspective view of an exemplary electrical solenoid switch 300 in an open/unpowered position in accordance with the present disclosure. FIG. 3B illustrates a perspective view of an exemplary electrical solenoid switch 300 in a closed/powered position in accordance with the present disclosure. FIG. 3C illustrates a perspective cross-sectional view of an exemplary electrical solenoid switch 300 in an open/unpowered position in accordance with the present disclosure. FIG. 3D illustrates a perspective cross-sectional view of an exemplary electrical solenoid switch 300 in a closed/powered position in accordance with the present disclosure.

The electrical solenoid switch 300, such as, for example, a bi-stable electrical solenoid switch, includes the solenoid bobbin 116 as described in FIG. 1. The solenoid bobbin 116 is formed within a solenoid body 150 (e.g., a solenoid body) with coil windings 102 wound around the solenoid bobbin 116. The solenoid body 150 includes a central aperture 175 defined therein, and the coil windings 102, which when engaged by a power source, generates a magnetic field. The solenoid body 150 also includes a solenoid frame 118 disposed beneath the solenoid bobbin 116 for additional support and protection of the solenoid body 150.

A magnetic coupling member 106, such as a magnet, may be mounted on, around, or in one of a variety of positions of the solenoid body 150. For example, the magnetic coupling member encases all or part of the solenoid body 150. In one embodiment, a defined portion of the solenoid body 150 includes the magnetic coupling member 106. In one embodiment, the solenoid body 150 is the magnetic coupling member 106. The magnetic coupling member 106 may surround at least a portion of the central aperture 175.

The plunger 104, as described in FIG. 1, is used for the electrical solenoid switch 300. The plunger 104 is at least partially disposed in the central aperture 175 for rotation and axial reciprocation between at least two positions into and out of the central aperture 175 relative to the solenoid body 150 and the magnetic coupling member 106. The plunger 104 is magnetically attracted towards the magnetic coupling member 106.

In one embodiment, a conductive plate 110 (e.g., an input bus bar or input conductive plate) and an output conductive plate 120 (e.g., an output bus bar) includes one or more electric contacts 114A. The one or more electric contacts 114A may be spaced a distance away from one another. In one embodiment, the conductive plate 110 and the output conductive plate 120 may be coupled to the plunger 104 with one or more electric contacts 114A provided on each end of the conductive plate 110 and the output conductive plate 120. In one embodiment, the electric contacts 114A are silver alloy contacts. The conductive plate 110 and the output conductive plate 120 may be configured to electrically engage and disengage the solenoid body 150 upon respective application of power to the solenoid body 150.

In one embodiment, the conductive plate 110 is coplanar with the output conductive plate 120. In one embodiment, a movable conductive plate 140 (e.g., a movable bus bar) is connected to the plunger 104 beneath the conductive plate 110 and the output conductive plate 120. The movable conductive plate 140 may be non-coplanar with the conductive plate 110 and the output conductive plate 120. The movable conductive plate 140, the conductive plate 110, and the output conductive plate 120 are movable with respect to one another along a direction parallel to or perpendicular to an axis, such as the Y-Axis or Z-axis, as the plunger is magnetically attracted towards and/or away from the magnetic coupling member 106.

The movable conductive plate 140 includes electric contacts 114B spaced a distance away from one another and are configured for electrically engaging and disengaging the electric contacts 114A from an open position (powered off) and/or a closed position (powered on) of the electrical solenoid switch 100. The conductive plate 110, the movable conductive plate 140, and the output conductive plate 120 may be formed of any suitable, electrically conductive material, such as copper or tin, and may be formed as a wire, a ribbon, a metal link, a spiral wound wire, a film, an electrically conductive core deposited on a substrate, or any other suitable structure or configuration for providing a circuit interrupt. The conductive materials may be decided based on fusing characteristic and durability. In one embodiment, the plunger 104 is a steel material and may include stainless steel caps covering the electric contacts 114A and the electric contacts 114B. The steep caps may be positioned on each end of the conductive plate 110, the movable conductive plate 140, and the output conductive plate 120. The electric contacts 114A and the electric contacts 114B may also be stainless steel.

A magnetic field latches and unlatches the plunger 104 between the at least two positions, such as the open position (powered off) and the closed position (powered on) of the electrical solenoid switch 100. The magnetic coupling member 106 is configured to reduce the force necessary by the magnetic field for allowing the solenoid body 150 to remain in an open position when selectively energized for operating in a constant current mode for allowing a wide operating voltage and reduced operating power. The magnetic coupling member 106 retains the plunger 104 in one of the at least two positions. The constant current mode allows for a multi-stage peak-an-hold current. The wide operating voltage is within a range of 5 to 32 volts.

The exemplary electrical solenoid switch 300 also includes the first spring 142, such as a return spring, disposed between the magnetic coupling member 106 and the movable conductive plate 140. In other words, the first spring 142 is positioned beneath the movable conductive plate 140 and above the magnetic coupling member 106. The first spring 142 receives the plunger. The first spring 142 creates a hammer effect to break the contacts between the electric contacts 114A and electric contacts 114B when power to the electrical solenoid switch 300 is removed. The first spring 142 may be configured to overcome the force of the magnetic coupling member 106 necessary to retain the conductive plate 110, which is energized, the movable conductive plate 140, and the output conductive plate 120 in an engaged position with solenoid body 150 so that the electrical solenoid switch 300 may be returned to the open position. The first spring 142 displaces the plunger 104 back to the closed position when the power source is disengaged from the solenoid body 150. By displacing the plunger 104 back to closed position, the first spring 142 overcomes the force of the magnetic coupling member 106 and the conductive plate 110 disengages the solenoid body 150.

The exemplary electrical solenoid switch 100 also includes a second spring 112, such as an over travel spring, disposed above the plunger 104 (e.g., on a top portion of the plunger 104) and in between the conductive plate 110 and the output conductive plate 120. The second spring 112 prevents the conductive plate 110, the movable conductive plate 140, and/or the output conductive plate 120 from traveling a distance that causes the conductive plate 110, the movable conductive plate 140, and/or the output conductive plate 120 to hit or make contact with a defined top portion of the plunger 104. In one embodiment, the first spring 142, together with the second spring 112, assist in securing the conductive plate 110, the movable conductive plate 140, and/or the output conductive plate 120 to the plunger 104 in a fixed and/or adjustable position. For example, the first spring 142, together with the second spring 112, are positioned such that the force of the first spring 142 pushing up from beneath the contact plate and the force of the second spring 112 pushing down from on the plunger 104, are such so as to assist the conductive plate 110, the movable conductive plate 140, and/or the output conductive plate 120 from bending or moving so as to remain parallel to the magnetic coupling member 106.

By displacing the plunger 104 back to closed position, the first spring 142 overcomes the force of the magnetic coupling member 106, and the conductive plate 110, the movable conductive plate 140, and/or the output conductive plate 120 disengages the solenoid body 150.

As illustrated in FIGS. 3A and 3B, the electric contacts 114B of the movable conductive plate 140 are electrically disengaged from the electric contacts 114A on the conductive plate 110 and the output conductive plate 120. Thus, the electrical solenoid switch 300 is in the open position (powered off). The magnetic field is unlatched from the plunger 104 between and the electrical solenoid switch 300. The magnetic coupling member 106 reduces the force necessary by the magnetic field for allowing the solenoid body 150 to remain in the open position when selectively energized for operating in a constant current mode for allowing a wide operating voltage and reduced operating power. The magnetic coupling member 106 retains the plunger 104 in open position (powered off).

The first spring 142 breaks the contacts between the electric contacts 114A and electric contacts 114B when power to the electrical solenoid switch 300 is removed. The first spring 142 is shown to overcome the force of the magnetic coupling member 106 necessary or required to retain the conductive plate 110, which is energized, the movable conductive plate 140, and the output conductive plate 120 in an engaged position with solenoid body 150 so that the electrical solenoid switch 300 may be returned to the open position. The first spring 142 displaces the plunger 104 back to the closed position when the power source is disengaged from the solenoid body 150. By displacing the plunger 104 back to closed position, the first spring 142 overcomes the force of the magnetic coupling member 106 and the conductive plate 110 disengages the solenoid body 150.

In other words, as the supply of the constant current to the coil windings 102 is suspended, the plunger 104 will be forced to return to an initial position (e.g., open position or "powered off" or a first position) by the restoring forces of the first spring 142 applied to the plunger 104 while simultaneously overcoming the magnetic attraction of the plunger 104 to the magnetic coupling member 106. The electric contacts 114A are disengaged from the solenoid conductive contacts, such as the electric contacts 114B, in the second position, and return to the open or "powered off" position when the plunger 104 is forced to return to its initial position (a first position) by the restoring forces of the first spring 142 applied to the plunger 104.

As illustrated in FIGS. 3C and 3D, the electric contacts 114B of the movable conductive plate 140 are electrically engaged with the electric contacts 114A on the conductive plate 110 and the output conductive plate 120. Thus, the electrical solenoid switch 300 is in the closed position (powered on).

As power is supplied to the electrical solenoid switch 300, the electromagnetic coil windings 102 are energized and the magnetic field is generated. The electric contacts 114B (e.g., solenoid conductive contacts) electrically engage electric contacts 114A (e.g., conductive plate contacts) when power to the electrical solenoid switch 300 is provided. The conductive plate 110, the movable conductive plate 140, and/or the output conductive plate 120, along with the plunger 104, move as a result of the magnetic field generated in the coil windings 102 and the magnetic coupling member 106.

The plunger 104, which has been held in an uppermost position (a first position) by the actions of the first spring 142, has been forced to move downwardly within the central aperture 175, while compressing the first spring 142 against the spring force of this the first spring 142. The downward movement is a result of a magnetic force generated within the coil windings 102, which have been energized from a constant current mode operation. Because the plunger 104 is magnetically attracted to the magnetic coupling member 106, the magnetic coupling member 106 reduces the overall amount of the magnetic force required for creating the downward movement of the plunger 104 and retaining the plunger 104 in this closed position. In the closed position, the electric contacts 114A mutually touch the solenoid conductive contacts, such as the electric contacts 114B, in the first position, such as a closed or "powered on" position.

The magnetic coupling member 106 reduces the force needed by the magnetic field for allowing the solenoid body 150 to remain in the closed position when selectively energized for operating in a constant current mode for allowing a wide operating voltage and reduced operating power. The magnetic coupling member 106 retains the plunger 104 in the closed position (powered off).

Figure 4:
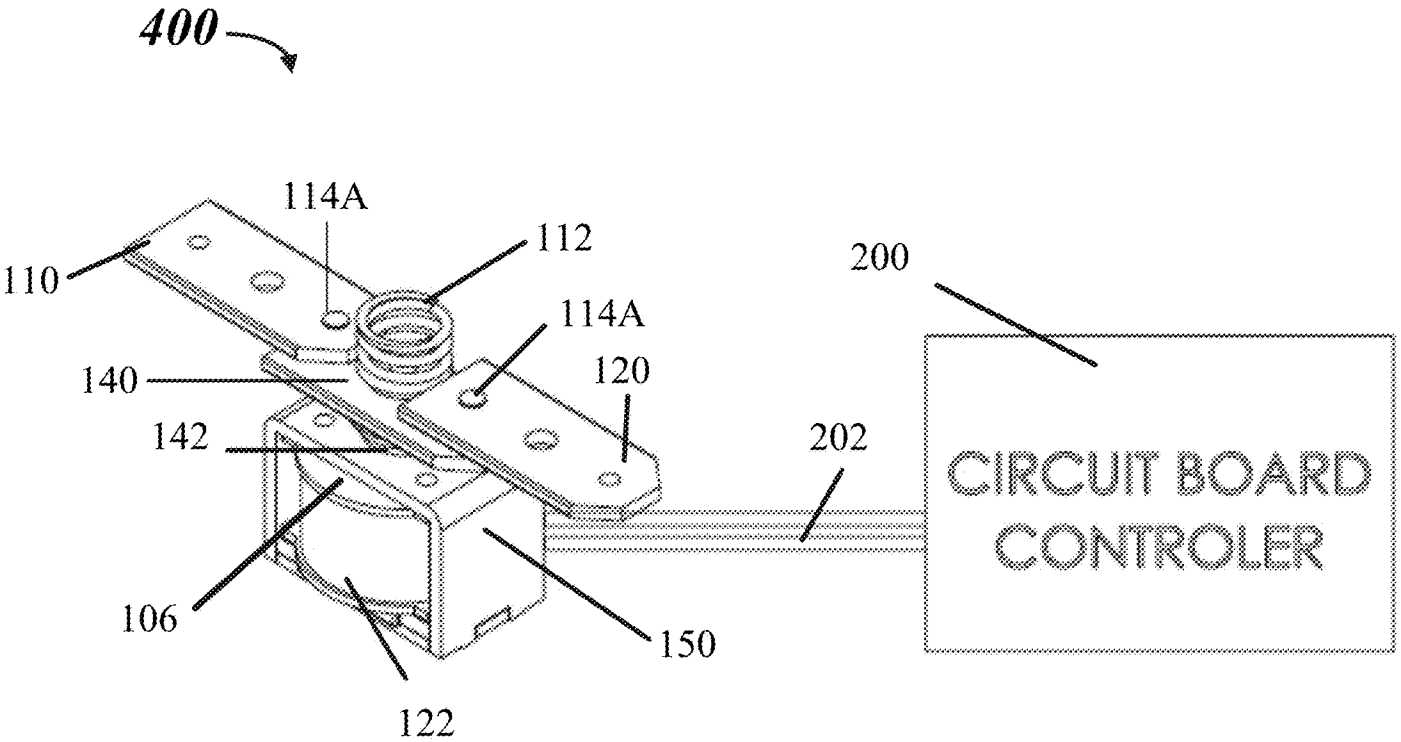
FIG. 4 illustrates a perspective view of the exemplary electrical solenoid switch in FIG. 3 connected to a circuit in accordance with the present disclosure.

FIG. 4 illustrates a perspective view of the exemplary electrical solenoid switch in FIG. 3 connected to a circuit in accordance with the present disclosure. A controller 200, such as printed circuit board assembly (PCBA) controller, is configured to receive the electrical solenoid switch 300 to provide electrical connection between the electrical solenoid switch 300, a power source, and other circuitry. An electrical connection 202 is provided for providing power to the electrical solenoid switch 300. More specifically, the coil windings 102 are connected to the controller 200.

As power is supplied via the controller through the connection to the coil windings 102 (e.g., electromagnetic coil windings), the plunger 104, which has been held in an uppermost position (e.g., a closed or powered off position or a first position) by the actions of the first spring 142 will be forced to move downwardly within the central aperture 175, while compressing the first spring 142 against the spring force of this the first spring 142. The downward movement is a result of a magnetic force generated within the coil windings 102, which have been energized from the constant current mode operation. Because the plunger 104 is magnetically attracted to the magnetic coupling member 106, the magnetic coupling member 106 reduces the overall amount of the magnetic force required for creating the downward movement of the plunger 104 and retaining the plunger 104 in this closed position. In the closed position, the electric contacts 114A mutually touch the solenoid conductive contacts, such as the electric contacts 114B, in the first position, such as a closed or "powered on" position.

When selectively energized, the plunger 104 is attracted into the central aperture 175. The conductive plate 110, the output conductive plate 120, and/or the movable conductive plate 140 that are attached to the plunger 104 move in the direction of the plunger causing the electric contacts 114A to mutually engage the electric contacts 114B in the first position (closed) when power is supplied by the controller 200.

When selectively de-energized by loss of power, the electric contacts 114A and the electric contacts 114B are mutually separated into the second position (open), with the magnetic coupling member 106 being a means for keeping the contacts in the first or in the second position. Thus, the magnetic coupling member 106 assist the plunger 104 to reduce the force needed by the coil windings 102 to hold the electrical solenoid switch 100 open and operate the coil windings in a constant current mode to allow multi-stage peak-and-hold current that allows wide operating voltage and lower operating power.

Then, as the supply of the constant current to the coil windings 102 are suspended, the plunger 104 will be forced to return to an initial position (e.g., closed or powered off position or a first position) by the restoring forces of the first spring 142 applied to the plunger 104 while simultaneously overcoming the magnetic attraction of the plunger 104 to the magnetic coupling member 106. The electric contacts 114A disengaged from the solenoid conductive contacts, such as the electric contacts 114B, in the second position, such as an open or "powered off" position when the plunger 104 is forced to return to an initial position (a first position) by the restoring forces of the first spring 142 applied to the plunger 104.

Figure 5:
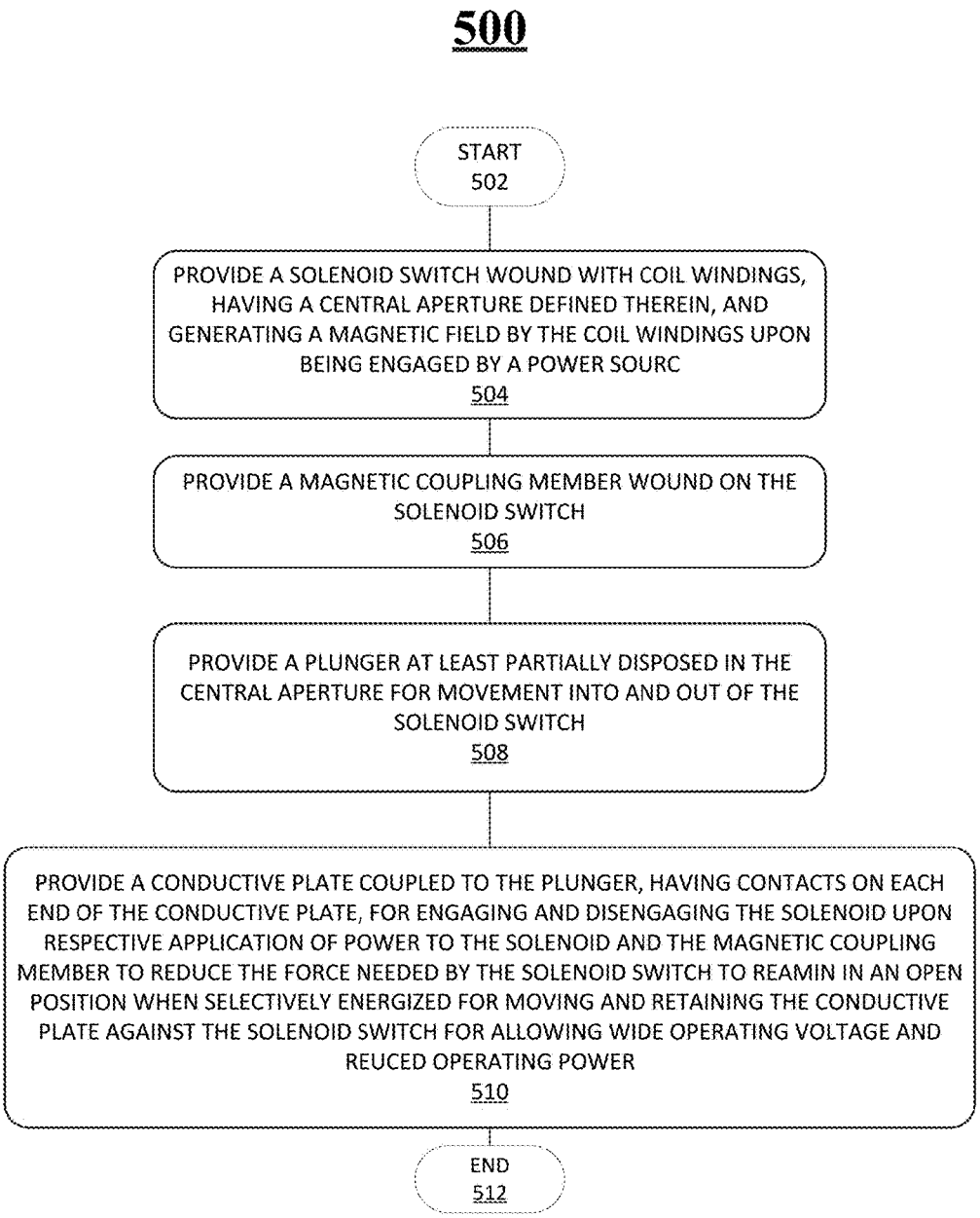
FIG. 5 illustrates a logic flow diagram in connection with the electrical solenoid switch.

FIG. 5 illustrates a logic flow diagram in connection with the fuse shown in FIG. 1. FIG. 5 is a flow chart illustrating a method 500 for providing bi-stable electrical solenoid switch, arranged in accordance with at least some embodiments of the present disclosure. In general, the method 500 is described with reference to FIGS. 1-2. It is to be appreciated, that the method 500 may also be used to manufacture the electrical solenoid switch 100 described or other fuses consistent with the present disclosure. The method 500 may begin at block 502. At block 504, a method provides a solenoid being wound with coil windings, the solenoid having a central aperture defined therein, and the coil windings, which when engaged by a power source, generates a magnetic field. At block 506, the method 500 provides a magnetic coupling member mounted on the solenoid. At block 508, the method 500 provides a plunger at least partially disposed in the central aperture for movement into and out of the central aperture of the solenoid switch. The method provides a conductive plate coupled to the plunger and provided with contacts on each end of the conductive plate, the conductive plate configured to electrically engage and disengage the solenoid upon respective application of power to the solenoid and the magnetic coupling member to reduce the force needed by the solenoid to remain in an open position when selectively energized for moving and retaining the conductive plate of the plunger against the solenoid for allowing wide operating voltage and reduced operating power at block 510. The method 500 ends at block 512.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure has been disclosed with reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A bi-stable solenoid electrical switch comprising:

a solenoid bobbin forming a solenoid by being wound with coil windings, the solenoid bobbin having a central aperture defined therein, and the coil windings, which when engaged by a power source, generates a magnetic field, the solenoid bobbin having a top portion including vertically extending contacts spaced apart to define a trench;

a magnetic coupling member mounted on the solenoid and disposed in the trench and proximate to the vertically extending contacts of the solenoid bobbin, the magnetic coupling member surrounding at least a portion of the central aperture;

a plunger at least partially disposed in the central aperture for rotation and axial reciprocation between at least two positions into and out of the central aperture relative to the solenoid and the magnetic coupling member;

a conductive plate having a first end opposite a second end, the conductive plate coupled to the plunger and having at least one contact disposed on each of the first end and the second end of the conductive plate and aligned with the solenoid bobbin contacts, the conductive plate configured to electrically engage and disengage the solenoid upon respective application of power to the solenoid, the magnetic field latching and unlatching the plunger between the at least two positions for engaging and disengaging the contacts of the conductive plate and the contacts of the solenoid bobbin; and a first spring configured to receive the plunger and disposed between the magnetic coupling member and the conductive plate, the first spring configured to overcome the force of the magnetic coupling member needed to retain the solenoid in the open position and displacing the plunger back to an alternative one of the at least two positions when the power source is disengaged from the solenoid;

wherein the magnetic coupling member is configured to reduce a force needed by the magnetic field for allowing the solenoid to remain in an open position when selectively energized for operating in a constant current mode for allowing a wide operating voltage and reduced operating power, the magnetic coupling member retaining the plunger in one of the at least two positions.

2. The bi-stable solenoid electrical switch according to claim 1, wherein the plunger is magnetically attracted towards the magnetic coupling member.

3. The bi-stable solenoid electrical switch according to claim 1, wherein the plunger includes a top portion, a middle portion, and a bottom portion, the bottom portion being least partially disposed in the central aperture and the middle portion coupled to the conductive plate.

4. The bi-stable solenoid electrical switch according to claim 3, further comprising a second spring disposed between the conductive plate and the top portion of the plunger.

5. The bi-stable solenoid electrical switch according to claim 1, wherein the wide operating voltage is within a range of 5 to 32 volts.

6. The bi-stable solenoid electrical switch according to claim 1, wherein the solenoid bobbin includes a body piece having the top section at a first end and a bottom section at a second end, the central aperture being formed within the body piece of the solenoid bobbin.

7. An electrical solenoid switch comprising:

a solenoid being wound with coil windings, the solenoid having a central aperture defined therein, and the coil windings, which when engaged by a power source, generates a magnetic field, the solenoid bobbin having a top portion including vertically extending contacts spaced apart to define a trench;

a magnetic coupling member mounted on the solenoid and disposed in the trench and proximate to the vertically extending contacts of the solenoid bobbin;

a plunger at least partially disposed in the central aperture for movement into and out of the central aperture;

a conductive plate having a first end opposite a second end, the conductive plate coupled to the plunger and having at least one contact disposed on each of the first end and the second end of the conductive plate and aligned with the solenoid bobbin contacts, the conductive plate configured to electrically engage and disengage the solenoid upon respective application of power to the solenoid for engaging and disengaging the contacts of the conductive plate and the contacts of the solenoid bobbin; and a first spring disposed between the magnetic coupling member and the conductive plate, the first spring configured to overcome the force needed to retain the solenoid in the open position and displacing the plunger back to an alternative one of the at least two positions when the power source is disengaged from the solenoid;

wherein the magnetic coupling member is configured to reduce a force needed by the solenoid to remain in an open position when selectively energized for moving and retaining the conductive plate of the plunger against the solenoid for allowing wide operating voltage and reduced operating power.

8. The electrical solenoid switch according to claim 7, wherein the solenoid is bi-stable.

9. The electrical solenoid switch according to claim 7, wherein the plunger includes a top portion, a middle portion, and a bottom portion, the bottom portion being least partially disposed in the central aperture and the middle portion coupled to the conductive plate.

10. The electrical solenoid switch according to claim 9, further comprising a second spring disposed between the conductive plate and the top portion of the plunger.

11. The electrical solenoid switch according to claim 7, wherein the wide operating voltage is within a range of 5 to 32 volts.

12. The electrical solenoid switch according to claim 7, wherein the solenoid bobbin includes a body piece having the top section at a first end and a bottom section at a second end, the central aperture being formed within the body piece of the solenoid bobbin.

13. A method of forming an electrical solenoid switch comprising:

providing a solenoid by being wound with coil windings, the solenoid having a central aperture defined therein, and the coil windings, which when engaged by a power source, generates a magnetic field, the solenoid bobbin having a top portion including vertically extending contacts spaced apart to define a trench;

providing a magnetic coupling member mounted on the solenoid and disposed in the trench and proximate to the vertically extending contacts of the solenoid bobbin;

providing a plunger at least partially disposed in the central aperture for movement into and out of the central aperture;

providing a conductive plate having a first end opposite a second end, the conductive plate coupled to the plunger and having at least one contact disposed on each of the first end and the second end of the conductive plate and aligned with the solenoid bobbin contacts, the conductive plate configured to electrically engage and disengage the solenoid upon respective application of power to the solenoid for engaging and disengaging the contacts of the conductive plate and the contacts of the solenoid bobbin; and providing a first spring disposed between the magnetic coupling member and the conductive plate, the first spring configured to overcome the force needed to retain the solenoid in the open position and displacing the plunger back to an alternative one of the at least two positions when the power source is disengaged from the solenoid;

wherein the magnetic coupling member is configured to reduce a force needed by the solenoid to remain in an open position when selectively energized for moving and retaining the conductive plate of the plunger against the solenoid for allowing wide operating voltage and reduced operating power.

14. The method of forming the electrical solenoid switch of claim 13, wherein the plunger includes a top portion, a middle portion, and a bottom portion, the bottom portion being least partially disposed in the central aperture and the middle portion coupled to the conductive plate.

15. The method of forming the electrical solenoid switch of claim 14, further providing a second spring disposed between the conductive plate and the top portion of the plunger.

16. The method of forming the electrical solenoid switch of claim 13, wherein the wide operating voltage is within a range of 5 to 32 volts.

17. The method of forming the electrical solenoid switch of claim 13, wherein the solenoid bobbin includes a body piece having the top section at a first end and a bottom section at a second end, the central aperture being formed within the body piece of the solenoid bobbin.

* * * * *